United States Patent [19]

Rapatel

[11] 4,110,851

[45] Sep. 5, 1978

[54] SANITARY APPLIANCE

[76] Inventor: Bernard Rapatel, 43 boulevard Ernest Renan, Firminy, Loire, France, 42700

[21] Appl. No.: 750,900

[22] Filed: Dec. 15, 1976

[51] Int. Cl.[2] ..... A47K 1/04; E03C 1/18

[52] U.S. Cl. ..... 4/166; 4/167; 4/170; 4/187 A

[58] Field of Search ..... 4/187 R, 167, 166, 198, 4/189, 199, 202, 170, 187 A; 156/242, 245

[56] References Cited

U.S. PATENT DOCUMENTS

| | | | |
|---|---|---|---|
| 1,578,849 | 3/1926 | Rogers | 4/170 |
| 1,600,852 | 9/1926 | Shaffen | 4/170 |
| 1,722,614 | 7/1929 | Watrous | 4/170 |
| 1,725,259 | 8/1929 | Dummett | 4/170 |
| 2,026,952 | 1/1936 | Reed et al. | 4/187 A |
| 2,062,809 | 12/1936 | Erickson | 4/187 R |
| 2,421,808 | 6/1947 | Robertson | 4/187 R |
| 2,769,181 | 11/1956 | Miller | 4/187 R |
| 2,810,917 | 10/1957 | Rhoades, Jr. | 4/170 |
| 2,818,581 | 1/1958 | Miller | 4/187 R |
| 2,847,681 | 8/1958 | Jacobs | 4/187 R |
| 3,508,282 | 4/1970 | Phillips, Jr. | 4/166 |
| 3,578,737 | 5/1971 | Ruggles | 4/187 R X |
| 3,673,617 | 7/1972 | Schulz, Jr. | 4/187 R |
| 3,729,750 | 5/1973 | Giglio | 4/187 R |
| 3,813,706 | 6/1974 | Williams | 4/187 R |
| 3,826,629 | 7/1974 | Pryor et al. | 4/187 R |
| 3,859,675 | 1/1975 | Van Manen et al. | 4/187 R |

*Primary Examiner*—Henry K. Artis
*Attorney, Agent, or Firm*—Eric P. Schellin

[57] ABSTRACT

A fixture includes a shelf with a sink formed integrally therewith. The shelf comprises a raised back surface which protects a wall from water which may be splashed thereon. Peripheral portions extend downward from the shelf on the front and side portions thereof, encompass the sink, and form a stable base for the unit. One or more drawers may be housed in the base.

1 Claim, 5 Drawing Figures

SANITARY APPLIANCE

The present invention relates to sanitary appliances.

It is known that use may be made in bathrooms of sanitary appliances such as washstands which do not have facilities for stowing toilet articles or other accessories required for personal hygiene. Also, known washstands are heavy, difficult to position and secure, and do not prevent water splashing on tiles usually affixed to an adjacent wall. Further, known washstands are costly by virtue of their design.

An object of the invention is to overcome these disadvantages.

According to the invention there is provided a sanitary appliance comprising at least one basin mounted in a shelved structure of large surface area, at least one edge of which is raised for abutting a wall and extending throughout the length of the shelved structure, the other edges being angled downwardly on the exposed sides of the shelving structure which is constructed in a single unit of moulded or injected and reinforced material.

The shelved structure may be produced from a substance consisting of plastics material which is moulded or injected and reinforced with glass fibre so that the washbasin shelf offers a reduced thickness, is light, is and very strong. A facing may be provided throughout the external surface of the washbasin shelf by means of a material, for example such as "Gelkot".

The washbasin shelf may be equipped with means of for fastening the fixture to a wall, and in a known manner, for connecting tap and drain fittings.

Preferably the basin has an opening acting as an overflow, together with a draining duct, which features are also made integrally of plastics material.

The invention will now be described by way of example with reference to the accompanying drawings wherein.

Figure 2:
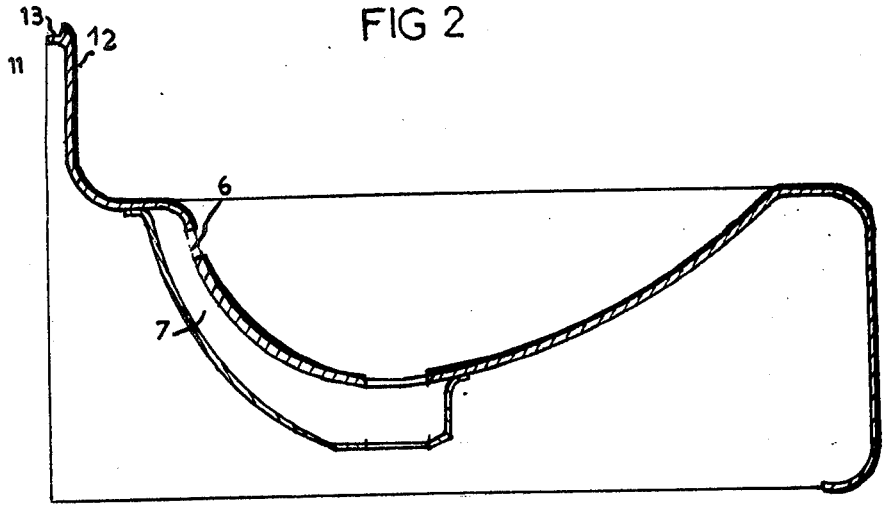
FIG. 2 is a view in cross-section along the line A—A of FIG. 1.
Figure 1:
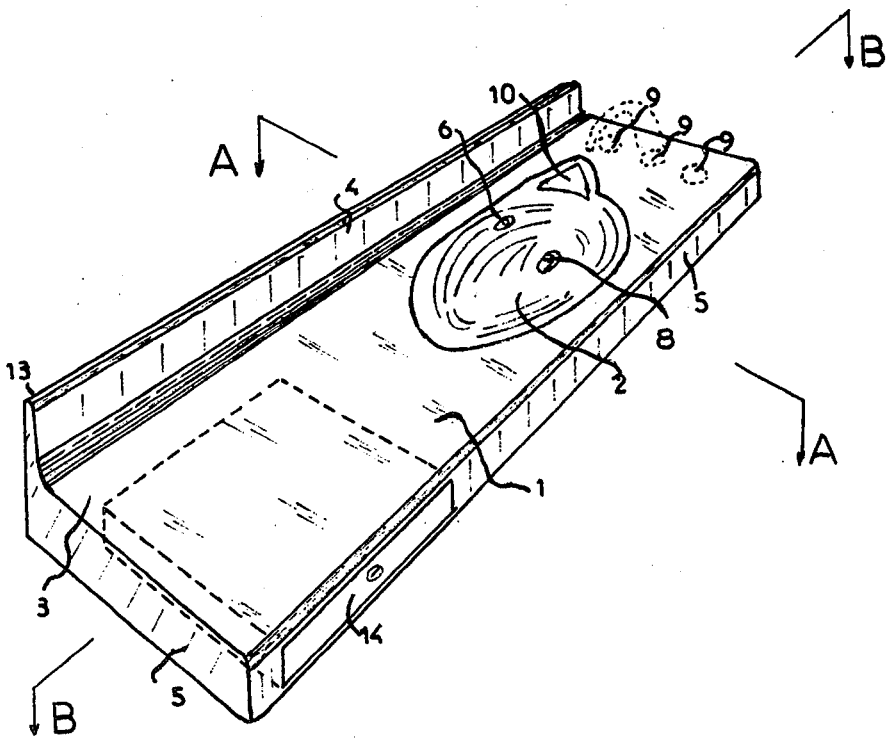
FIG. 1 is a perspective view of a washbasin shelf.
Figure 3:
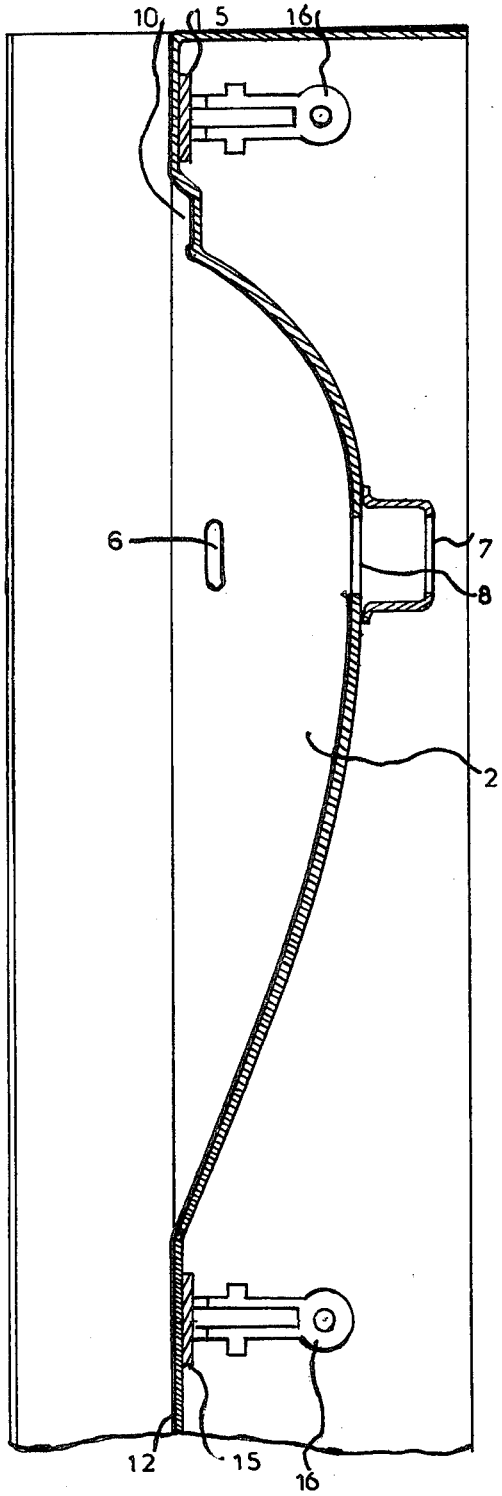
FIG. 3 is a view in longitudinal cross-section view along the line B—B of FIG. 1.
Figure 4:
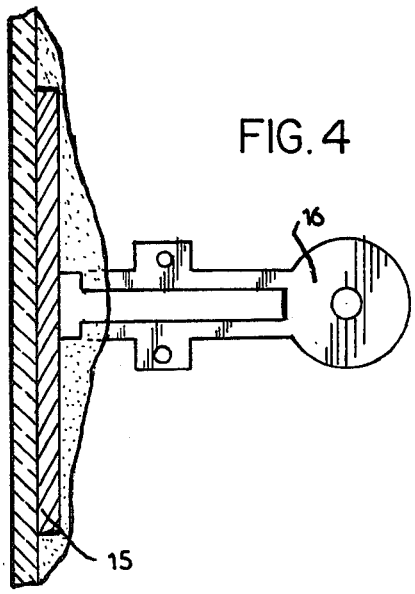
FIG. 4 is a partial front view of means for securing the washbasin shelf by means of brackets.
Figure 5:
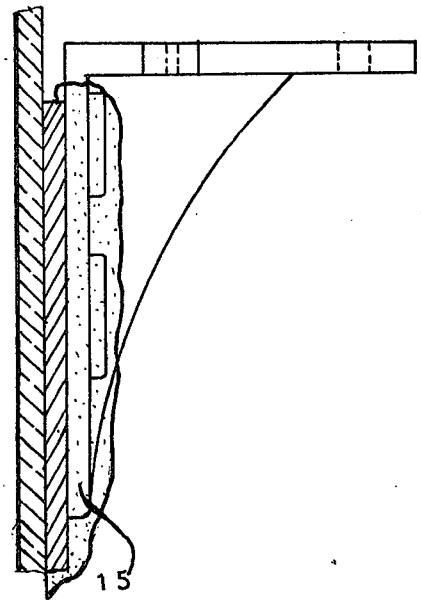
FIG. 5 is a sideview corresponding to FIG. 4.

The washbasin shelf shown in FIG. 1 of the drawings is formed of a single unit 1 having at least one contoured basin 2 formed in a shelf 3. At least one edge 4 of the unit is raised to lie against the wall and the remaining peripheral edges are squared off along the exposed side or sides 5.

The basin 2 may be round, or oblong or some other shape as desired, and it is possible in particular to form the basin in the shape of a bowl, thus offering a maximum volume of water for a minimum depth. The basin has an orifice 6 which acts as an overflow, and communicates with an inset draining duct 7. In particular, provision may be made for bonding or otherwise affixing the duct 7 to the unexposed surface of the basin. At its lower part, the draining duct has a draining orifice, which is preferably situated in the same vertical as the draining orifice 8 in the basin 2. The washbasin shelf forms a sanitary unit, and provision is made for the installation of tap elements 9 at the sides of the basin. It should be noted that the tap elements 9 are held for example, by means of clips 9[1], which may easily be removed. A soap holder 10 is formed beside the basin in a plane which is lower than that of the shelf 3. The raised edge 4 renders it possible to protect the area behind the unit against water splashes. The height of the raised edge may be varied while its length corresponds precisely to the length of the washbasin shelf 3. The raised edge 4 which abuts a wall has, along its top edge, a horizontal surface directed towards the fastening surface of the washbasin shelf. This surface is preferably formed on the glass-fibre portion 11 forming the washbasin shelf, and not on the outer facing 12. This surface moreover has a squared longitudinal groove 13, of a length equal to the length of the washbasin shelf, and wherein may be positioned or rested a mirror or tilting.

The sanitary unit has a downwardly angled edge on the exposed side or sides. One or more drawers 14 may be provided in the shelf as desired, sliding in the downwardly angled edge or edges.

The unit should have features of strength, thus in order to provide reinforcement, a reinforcing plate 15 bearing against the inner surface of the shelf, is positioned within the washbasin shelf by any known fastening means. In particular, provision may be made for the reinforcing plate 15 to be embedded in the fibre glass. The reinforcing plate may formed of rigid material such as agglomerate, plywood, plastics material or any other material offering properties having the result of reinforcing the shelf. The reinforcing plate may be formed of one or several parts. The plate may be sized to correspond to the entire usable under surface of the shelf, excepting at the location of the basin.

The washbasin shelf may be secured to a wall by means of metal brackets 16 the brackets varying in number depending on the length of the shelf. The brackets may be positioned and secured on the reinforcing plate by any suitable fastening means. In particular, provision may be made for the vertical lugs of the brackets to be placed against the reinforcing plates and to be imbedded in the fibre glass during the moulding operation.

The washbasin shelf is constructed of plastics material which is injection molded or moulded and reinforced with fibre glass. The facing 12 may be made in known manner from a material such as "Gelkot" or from any other suitable material known to those skilled in the art.

The invention is not to be limited in any way to the form of the specific embodiments herein described but rather to be construed as encompassing those modifications and alterations which will be apparent to those skilled in the art.

What I claim is:

1. A sanitary lavatory and vanity fixture combination of an integrally formed polyester reinforced with fiber glass construction comprising an elongated shelf top having a large vanity surface area, at least one ovoid basin integrally formed in said shelf and flush with said shelf top, said basin having a depth to provide a maximum water level for a minimum water depth, a first drain means and a second drain means in said basin where said first drain means is vertically below and in line with said second drain means, an overflow duct affixed to said basin for connecting said first drain means to said second drain means, said overflow duct having an outlet drain means, a raised wall means formed along one edge of the shelf top and having a longitudinal groove formed along an upper edge, a pair of opposited end wall means formed on opposite ends of said shelf, a front wall means formed on said shelf top opposite said raised wall means, said pair of opposited end wall means and said front wall means having a height measured from said shelf top which is greater than the depth of said basin measured from said shelf top, whereby said pair of opposited end wall means and said front wall means comprise a stable base for said fixture, at least two rigid reinforcing plate means for reinforcing said shelf top, said rigid reinforcing plate means being imbedded in the underside of said shelf means in a region adjacent said raised wall means, at least two supporting brackets bonded to said reinforcing plate means to form an integral unit with said rigid reinforcing plate means, each of said brackets being adapted for attachment to a vertical support, said fixture including tap elements connected to said shelf top in the region of said basin and a soap holder means incorporated beside said basin, said soap holder means being in a plane which is lower than that of the shelf top.

* * * * *